US010072675B2

(12) United States Patent
McLean, Jr. et al.

(10) Patent No.: US 10,072,675 B2
(45) Date of Patent: Sep. 11, 2018

(54) SYSTEM FOR USING PRESSURE EXCHANGER IN DUAL GRADIENT DRILLING APPLICATION

(71) Applicant: Energy Recovery, Inc., San Leandro, CA (US)

(72) Inventors: James Elliott McLean, Jr., Houston, TX (US); Farshad Ghasripoor, Oakland, CA (US); David Deloyd Anderson, Castro Valley, CA (US); Jeremy Grant Martin, Oakland, CA (US)

(73) Assignee: ENERGY RECOVERY, LLC, San Leandro, CA (US)

( * ) Notice: Subject to any disclaimer, the term of this patent is extended or adjusted under 35 U.S.C. 154(b) by 0 days.

(21) Appl. No.: 15/492,788

(22) Filed: Apr. 20, 2017

(65) Prior Publication Data

US 2017/0306986 A1 Oct. 26, 2017

Related U.S. Application Data

(60) Provisional application No. 62/325,697, filed on Apr. 21, 2016.

(51) Int. Cl.

| | |
|---|---|
| ***E21B 21/00*** | (2006.01) |
| ***E21B 21/06*** | (2006.01) |
| ***E21B 21/08*** | (2006.01) |
| ***E21B 43/36*** | (2006.01) |
| ***F04F 13/00*** | (2009.01) |

(52) U.S. Cl.

CPC ..... *F04F 13/00* (2013.01); *E21B 21/001* (2013.01); *E21B 21/062* (2013.01); *E21B 21/065* (2013.01); *E21B 21/08* (2013.01); *E21B 43/36* (2013.01)

(58) Field of Classification Search

CPC .... E21B 21/001; E21B 21/062; E21B 21/065; E21B 43/36; E21B 21/08; F04F 13/00

See application file for complete search history.

(56) References Cited

U.S. PATENT DOCUMENTS 6,325,159 B1 * 12/2001 Peterman ..... E21B 21/001 166/350
7,735,563 B2 * 6/2010 Judge ..... E21B 43/121 166/344

(Continued)

FOREIGN PATENT DOCUMENTS

WO 2009/051474 A1 4/2009
WO 2014/018585 A1 1/2014
WO WO-2014018585 A1 * 1/2014 ..... E21B 43/36

OTHER PUBLICATIONS

U.S. Appl. No. 62/403,488, filed Oct. 3, 2016, Adam Rothschild Hoffman.

(Continued)

*Primary Examiner* — Matthew R Buck
(74) *Attorney, Agent, or Firm* — Fletcher Yoder, P.C.

(57) ABSTRACT

A system includes a mud return system. The mud return system includes a pressure exchanger (PX) configured to be installed in a body of water, to receive used drilling mud, to receive a second fluid, to utilize the second fluid to pressurize the drilling mud for transport, via a mud return line, from a first location at or near the sea floor to a second location at or near a surface of the body of water.

19 Claims, 7 Drawing Sheets

(56) References Cited

U.S. PATENT DOCUMENTS

| | | | | |
|---|---|---|---|---|
| 8,322,435 | B2 * | 12/2012 | Judge | E21B 43/121 166/344 |
| 9,534,458 | B2 * | 1/2017 | Duman | E21B 21/001 |
| 2004/0007392 | A1 | 1/2004 | Judge et al. | |
| 2004/0031622 | A1 * | 2/2004 | Butler | E21B 21/001 175/5 |
| 2006/0204375 | A1 * | 9/2006 | Judge | F04B 9/1235 417/393 |
| 2013/0280038 | A1 * | 10/2013 | Martin | F03B 13/00 415/110 |
| 2014/0128655 | A1 * | 5/2014 | Arluck | C07C 7/11 585/860 |
| 2014/0128656 | A1 * | 5/2014 | Arluck | C07C 7/11 585/860 |
| 2015/0096739 | A1 * | 4/2015 | Ghasripoor | E21B 43/16 166/105 |
| 2015/0184492 | A1 | 7/2015 | Ghasripoor | |
| 2015/0275602 | A1 * | 10/2015 | Kjosnes | E21B 33/085 175/25 |

OTHER PUBLICATIONS

International Search Report and Written Opnion for PCT/US2017/028760 dated Sep. 20, 2017; 13 pages.

* cited by examiner

SYSTEM FOR USING PRESSURE EXCHANGER IN DUAL GRADIENT DRILLING APPLICATION

CROSS REFERENCE TO RELATED APPLICATION

This application claims priority to and benefit of U.S. Patent Application No. 62/325,697, entitled "SYSTEM FOR USING PRESSURE EXCHANGER IN DUAL GRADIENT DRILLING APPLICATION", filed Apr. 21, 2016, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

The subject matter disclosed herein relates to fluid handling, and, more particularly, to systems and methods for pumping used drilling fluids ("drilling mud") from the sea floor to the surface in subsea dual gradient drilling applications.

Drilling mud is used in oil and gas drilling applications to provide hydraulic power, cooling, kick prevention, and to carry cuttings away from the cutting head. In subsea drilling applications, drilling mud is typically pumped from a rig or ship at the surface of the water down to the cutting head via a drill string. The used drilling mud and the cuttings then flow back up through an annulus between the drill string and a casing.

In riser drilling applications, the mud is pumped all the way back up to the rig or ship at the surface via the annulus. However, pumping the mud to the surface through the annulus, especially in applications having greater depths, uses large pumps and thick riser piping while causing high bottom hole hydrostatic pressure. The high internal pressures may lead to degradation and damage of the formation.

In dual gradient drilling applications, the mud is only pumped back up through the annulus to the sea floor. A diaphragm, disc pump, or centrifugal pump is then used to pump the used mud back up to the surface via a mud return line. The lifespan of a diaphragm pump may be cut short by rupturing of the diaphragm. Repair or replacement of the diaphragm pump at the sea floor may be expensive, time consuming, and a logistical challenge. Disc pumps, on the other hand, may only be 15% to 25% efficient, resulting in large disc pumps, and excess heat that heats the fluids. Accordingly, further development of pumps for dual gradient drilling applications is desired.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
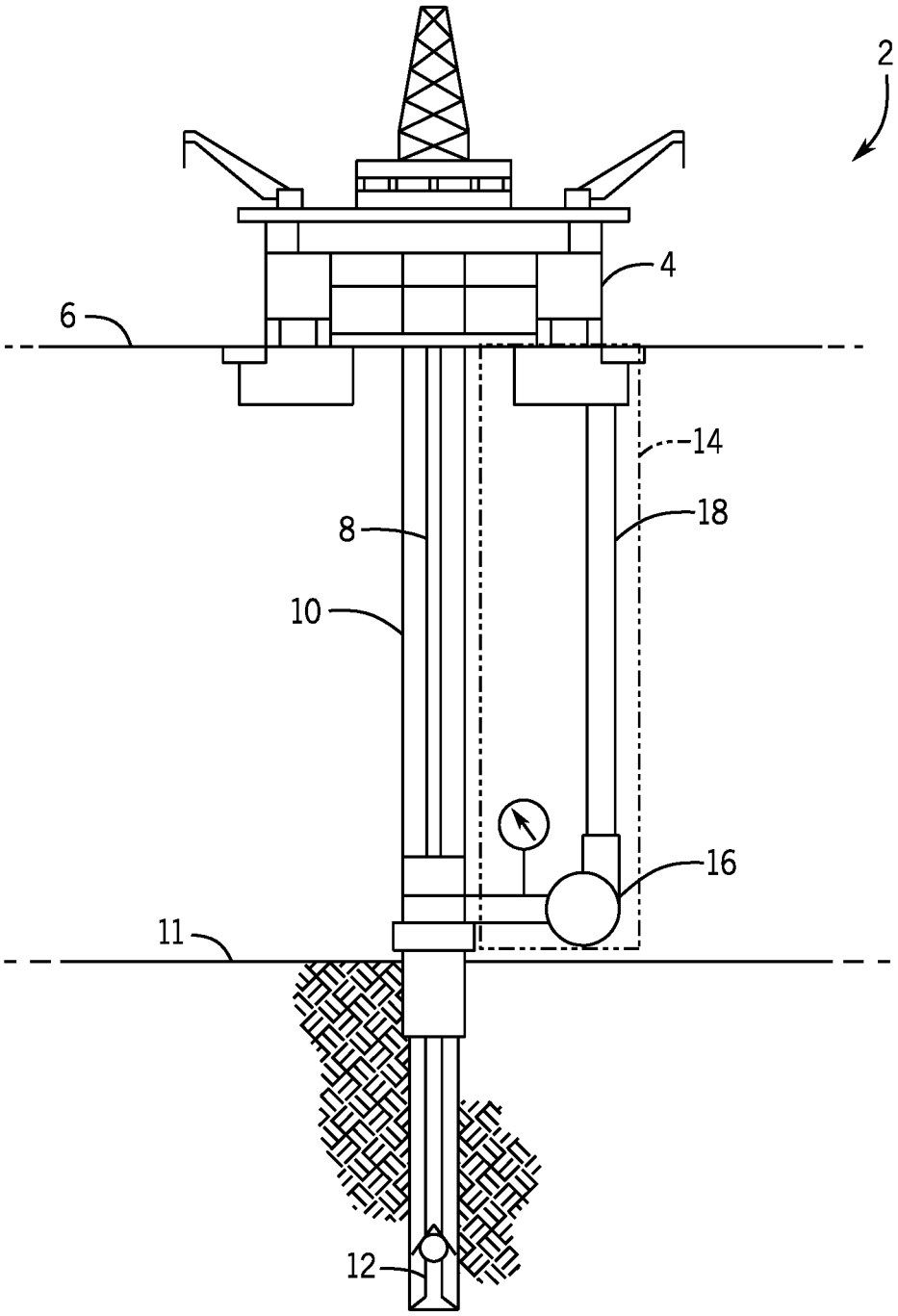
FIG. 1 is a schematic view of an embodiment of a dual gradient drilling application.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

In subsea drilling applications using riser drilling, used drilling mud is pumped through an annulus between a drill string and a casing all the way back up to a rig or ship at the surface. This results in high internal pressures, which may lead to damage to the formation, large pumps and thick riser piping. In dual gradient drilling, the used mud is only pumped up through the annulus to the sea floor. The used mud is then pumped up to the surface via mud return line by a mud lift pump (e.g., a diaphragm pump or a disc pump). Diaphragm pumps may experience shortened lifespans in dual gradient drilling due to diaphragm rupture. Disc pumps, the most commonly used alternative to diaphragm pumps, may only be 15% to 25% efficient, resulting in large disc pumps, and excess heat transferred to the surrounding fluids.

As discussed in detail below, a mud return system includes a mud lift pump (MLP) may be a hydraulic energy transfer system, such as a pressure exchanger (PX) that transfers work and/or pressure between first and second fluids. In some embodiments, the hydraulic energy transfer system may be a rotating isobaric pressure exchanger that transfers pressure between a high pressure fluid (e.g., high pressure energizing fluid, such as produced water or pressurized seawater) and a low pressure fluid (e.g., used drilling mud). Pressurizing the used drilling mud enables mud to be pumped from the sea floor to the rig or ship at the surface for treatment (e.g., cleaning, cooling, etc.). The utilization of the PX in the MLP eliminates or reduces the need for high pressure, high flow rate pumps (e.g., diaphragm pumps or disk pumps) to be located at an intermediate elevation between the annulus and the rig, such as the sea floor. In addition, the utilization of the PX eliminates or reduces the need for the provision of subsea power (e.g., electricity) utilized to run the pumps. Indeed, use of a hydraulic PX would require little to no electrical power. Yet further, the utilization of the PX may reduce the size of an accompanying valve system as compared to the valve system for a diaphragm or disc pump. Still further, the utilization of the PX is a simple solution. The PX is compact, durable, easy to maintain, and can easily be deployed with redundancy.

The PX may include one or more chambers (e.g., 1 to 100) to facilitate pressure transfer and equalization of pressures between volumes of first and second fluids. In some embodiments, the pressures of the volumes of first and second fluids may not completely equalize. Thus, in certain embodiments, the PX may operate isobarically, or the PX may operate substantially isobarically (e.g., wherein the pressures equalize within approximately +/−1, 2, 3, 4, 5, 6, 7, 8, 9, or 10 percent of each other). In certain embodiments, a first pressure of a first fluid (e.g., a high pressure energized fluid from the rig or ship) may be greater than a second pressure of a second fluid (e.g., used drilling mud). For example, the first pressure may be between approximately 5,000 kPa to 25,000 kPa, 20,000 kPa to 50,000 kPa, 40,000 kPa to 75,000 kPa, 75,000 kPa to 100,000 kPa or greater than the second pressure. Thus, the PX may be used to transfer pressure from a first fluid (e.g., high pressure energized fluid from the rig or ship) at a higher pressure to a second fluid (e.g., used drilling mud) at a lower pressure.

FIG. 1 is a schematic view of an embodiment of a dual gradient drilling application 2. As illustrated, a vessel 4 (e.g., a ship or a rig) sits on the surface 6 of the ocean. A drill string 8 extends through a casing 10 from the vessel 4 to the sea floor 11 and into the earth, where a cutting head 12 drills into the earth. Drilling fluids ("drilling mud") is typically pumped down the drill string 8 to the cutting head 12 to provide hydraulic power, cooling, and displacement of the cuttings. The used drilling mud is then pumped up, away from the cutting head 12, and through the annulus between the drill string 8 and the casing 10. The used mud carries the cutting away from the cutting head 12. In typical riser drilling applications, the used mud is pumped up through the annulus between the drill string and either the casing or riser all the way back up to the vessel 4 at the surface 6. However, pumping the mud to the surface through the casing requires much higher internal pressures, requiring large pumps, thicker riser piping, and more casing strings. Moreover, the higher internal pressures may lead to damage to the formation.

In dual gradient drilling, the used mud is only pumped through the annulus in the casing 10 up to the sea floor 11 or an intermediate point on the riser between the sea floor and the drill rig. The used mud is then diverted out of the casing 10 to a mud return system 14. The used mud is returned to the vessel 4 at the surface 6 by a mud lift pump (MLP) 16 via a mud return line 18. Typically, the MLP is a diaphragm or disc pump. However, diaphragm pumps may rupture. Replacing or repairing a pump on the sea floor 11 may be an expensive, time consuming, and logistically challenging task. Though disc pumps may be more durable that diaphragm pumps, disc pumps are only 15-25% efficient, meaning that large pumps may be required for the desired pressures and that energy lost to low efficiency may heat the fluids to undesirable temperatures. In the illustrated embodiment, one or more PXs are used as the MLP to pump the used mud up through the mud return line 18 and back up to the vessel 4 on the surface 6 for treatment.

Figure 2:
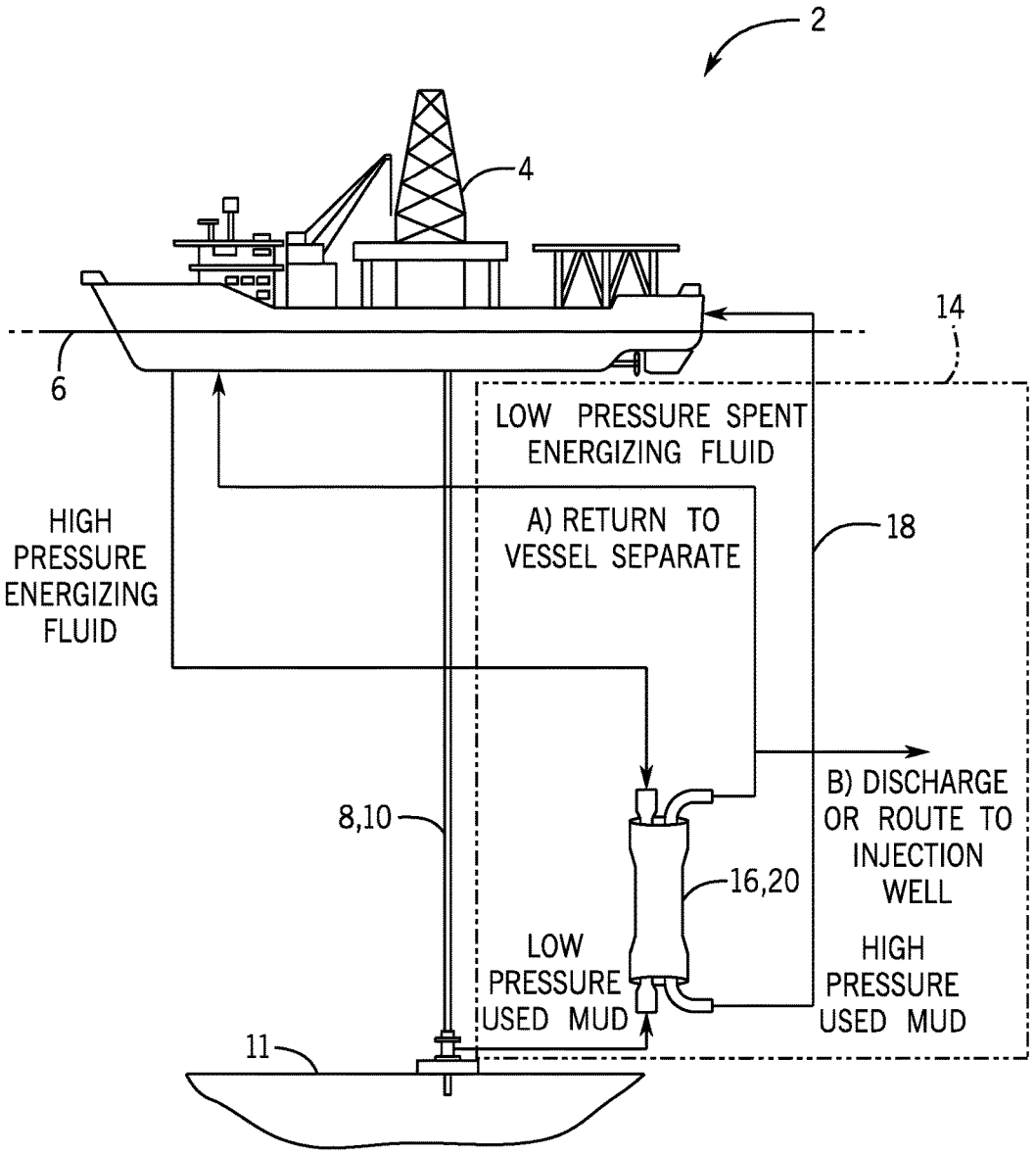
FIG. 2 is a schematic view of a dual gradient drilling application utilizing a pressure exchanger (PX) as a mud lift pump (MLP) in a mud return system.

FIG. 2 is a schematic view of a dual gradient drilling application 2 utilizing a PX 20 as the MLP 16 in the mud return system 14. It should be understood, that though a single PX 20 is shown and described, that the MLP 16 may include multiple PXs 20 connected in series or in parallel. As illustrated, low pressure used mud and high pressure energizing fluid are input to the PX 20. The PX 20 exchanges the pressures to pressurize the used mud and depressurize the energizing fluid. The high pressure used mud is fed through the mud return line 18 back up to the vessel 4 at the surface. The low pressure energized fluid may then be discharged into the ocean, routed to an injection well, or routed back up to the vessel 4. The specific operation of the PX 20 is described below with regard to FIGS. 3-5.

Figure 3:
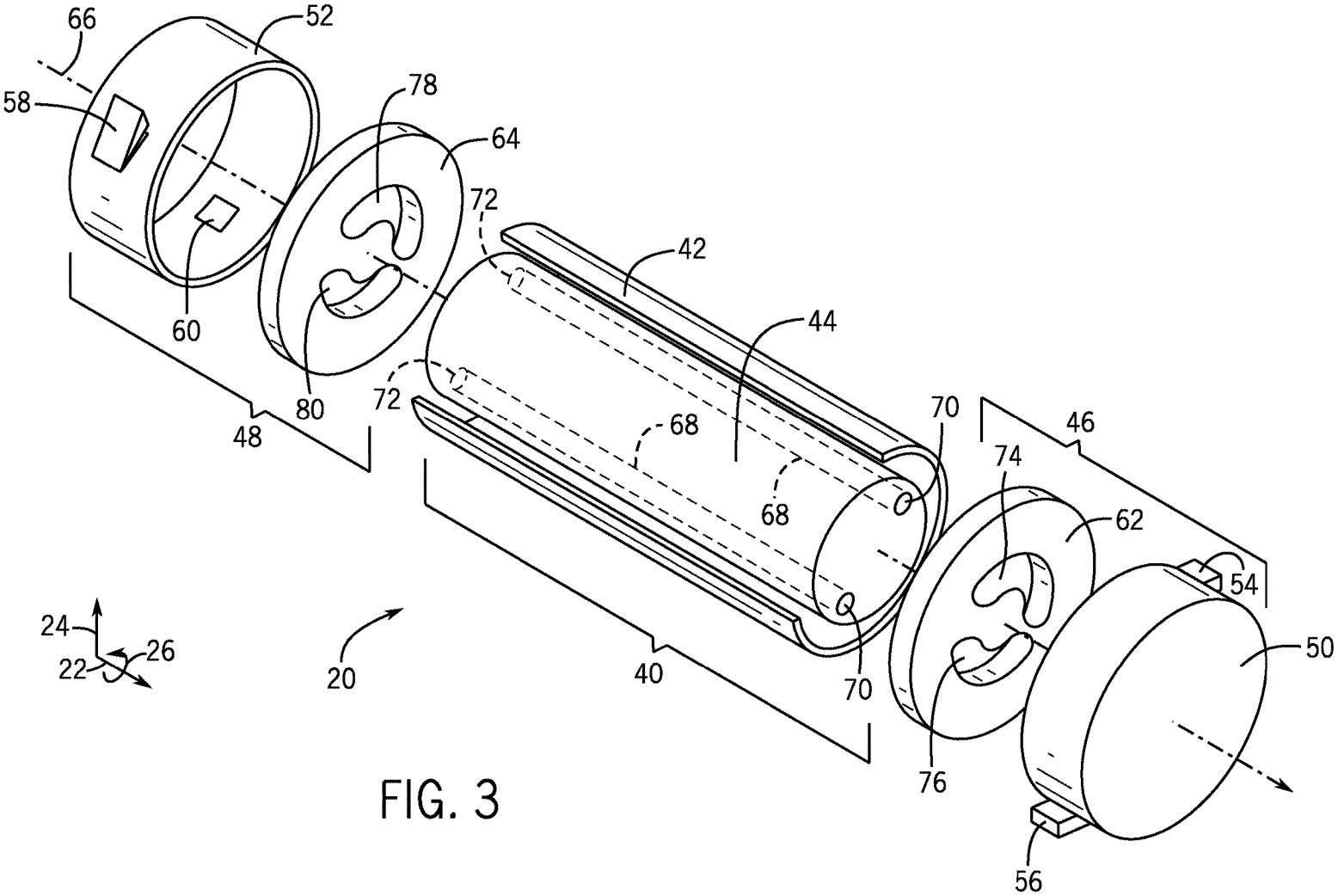
FIG. 3 is an exploded perspective view of an embodiment of a pressure exchanger (PX)

FIG. 3 is an exploded view of an embodiment of a rotary PX 20 that may be utilized as an MLP in a mud return system, as described in detail below. As used herein, the pressure exchanger (PX) may be generally defined as a device that transfers fluid pressure between a high-pressure inlet stream and a low-pressure inlet stream at efficiencies in excess of approximately 50%, 60%, 70%, or 80% without utilizing centrifugal technology. In this context, high pressure refers to pressures greater than the low pressure. The low-pressure inlet stream of the PX may be pressurized and exit the PX at high pressure (e.g., at a pressure greater than that of the low-pressure inlet stream), and the high-pressure inlet stream may be depressurized and exit the PX at low pressure (e.g., at a pressure less than that of the high-pressure inlet stream). Additionally, the PX may operate with the high-pressure fluid directly applying a force to pressurize the low-pressure fluid, with or without a fluid separator between the fluids. Examples of fluid separators that may be used with the PX include, but are not limited to, pistons, bladders, diaphragms and the like. In certain embodiments, isobaric pressure exchangers may be rotary devices. Rotary isobaric pressure exchangers (PXs) 20, such as those manufactured by Energy Recovery, Inc. of San Leandro, Calif., may not have any separate valves, since the effective valving action is accomplished internal to the device via the relative motion of a rotor with respect to end covers, as described in detail below with respect to FIGS. 2-7. Rotary PXs may be designed to operate with internal pistons to isolate fluids and transfer pressure with little mixing of the inlet fluid streams. Reciprocating PXs may include a piston moving back and forth in a cylinder for transferring pressure between the fluid streams. Any PX or plurality of PXs may be used in the disclosed embodiments, such as, but not limited to, rotary PXs, reciprocating PXs, or any combination thereof. While the discussion with respect to certain embodiments for measuring the speed of the rotor may refer to rotary PXs, it is understood that any PX or plurality of PXs may be substituted for the rotary PX in any of the disclosed embodiments.

In the illustrated embodiment of FIG. 3, the PX 20 may include a generally cylindrical body portion 40 that includes a housing 42 and a rotor 44. The rotary PX 20 may also include two end structures 46 and 48 that include manifolds 50 and 52, respectively. Manifold 50 includes inlet and outlet ports 54 and 56 and manifold 52 includes inlet and outlet ports 60 and 58. For example, inlet port 54 may receive a high-pressure first fluid and the outlet port 56 may be used to route a low-pressure first fluid away from the PX 20. Similarly, inlet port 60 may receive a low-pressure second fluid and the outlet port 58 may be used to route a high-pressure second fluid away from the PX 20. The end structures 46 and 48 include generally flat end plates 62 and 64, respectively, disposed within the manifolds 50 and 52, respectively, and adapted for liquid sealing contact with the rotor 44. The rotor 44 may be cylindrical and disposed in the housing 42, and is arranged for rotation about a longitudinal axis 66 of the rotor 44. The rotor 44 may have a plurality of channels 68 extending substantially longitudinally through the rotor 44 with openings 70 and 72 at each end arranged symmetrically about the longitudinal axis 66. The openings 70 and 72 of the rotor 44 are arranged for hydraulic communication with the end plates 62 and 64, and inlet and outlet apertures 74 and 76, and 78 and 80, in such a manner that during rotation they alternately hydraulically expose liquid at high pressure and liquid at low pressure to the respective manifolds 50 and 52. The inlet and outlet ports 54, 56, 58, and 60, of the manifolds 50 and 52 form at least one pair of ports for high-pressure liquid in one end element 46 or 48, and at least one pair of ports for low-pressure liquid in the opposite end element, 48 or 46. The end plates 62 and 64, and inlet and outlet apertures 74 and 76, and 78 and 80 are designed with perpendicular flow cross sections in the form of arcs or segments of a circle.

With respect to the PX 20, an operator has control over the extent of mixing between the first and second fluids, which may be used to improve the operability of the MLP 16. For example, varying the proportions of the first and second fluids entering the PX 20 allows the operator to control the amount of fluid mixing within the MLP 16. Three characteristics of the PX 20 that affect mixing are: the aspect ratio of the rotor channels 68, the short duration of exposure between the first and second fluids, and the creation of a liquid barrier (e.g., an interface) between the first and second fluids within the rotor channels 68. First, the rotor channels 68 are generally long and narrow, which stabilizes the flow within the PX 20. In addition, the first and second fluids may move through the channels 68 in a plug flow regime with very little axial mixing. Second, in certain embodiments, at a rotor speed of approximately 1200 RPM, the time of contact between the first and second fluids may be less than approximately 0.15 seconds, 0.10 seconds, or 0.05 seconds, which again limits mixing of the streams. Third, a small portion of the rotor channel 68 is used for the exchange of pressure between the first and second fluids. Therefore, a volume of fluid remains in the channel 68 as a barrier between the first and second fluids. All these mechanisms may limit mixing within the PX 20.

In addition, because the PX 20 is configured to be exposed to the first and second fluids, certain components of the PX 20 may be made from materials compatible with the components of the first and second fluids. In addition, certain components of the PX 20 may be configured to be physically compatible with other components of the fluid handling system. For example, the ports 54, 56, 58, and 60 may comprise flanged connectors to be compatible with other flanged connectors present in the piping of the fluid handling system. In other embodiments, the ports 54, 56, 58, and 60 may comprise threaded or other types of connectors.

FIGS. 4-7 are exploded views of an embodiment of the rotary PX 20 illustrating the sequence of positions of a single channel 68 in the rotor 44 as the channel 68 rotates through a complete cycle, and are useful to an understanding of the rotary PX 20. It is noted that FIGS. 4-7 are simplifications of the rotary PX 20 showing one channel 68 and the channel 68 is shown as having a circular cross-sectional shape. In other embodiments, the rotary PX 20 may include a plurality of channels 68 (e.g., 2 to 100) with different cross-sectional shapes. Thus, FIGS. 4-7 are simplifications for purposes of illustration, and other embodiments of the rotary PX 20 may have configurations different from that shown in FIGS. 4-7. As described in detail below, the rotary PX 20 facilitates a hydraulic exchange of pressure between two liquids by putting them in momentary contact within a rotating chamber. In certain embodiments, this exchange happens at a high speed that results in very high efficiency with very little mixing of the liquids.

Figures 4, 5, 6, 7:
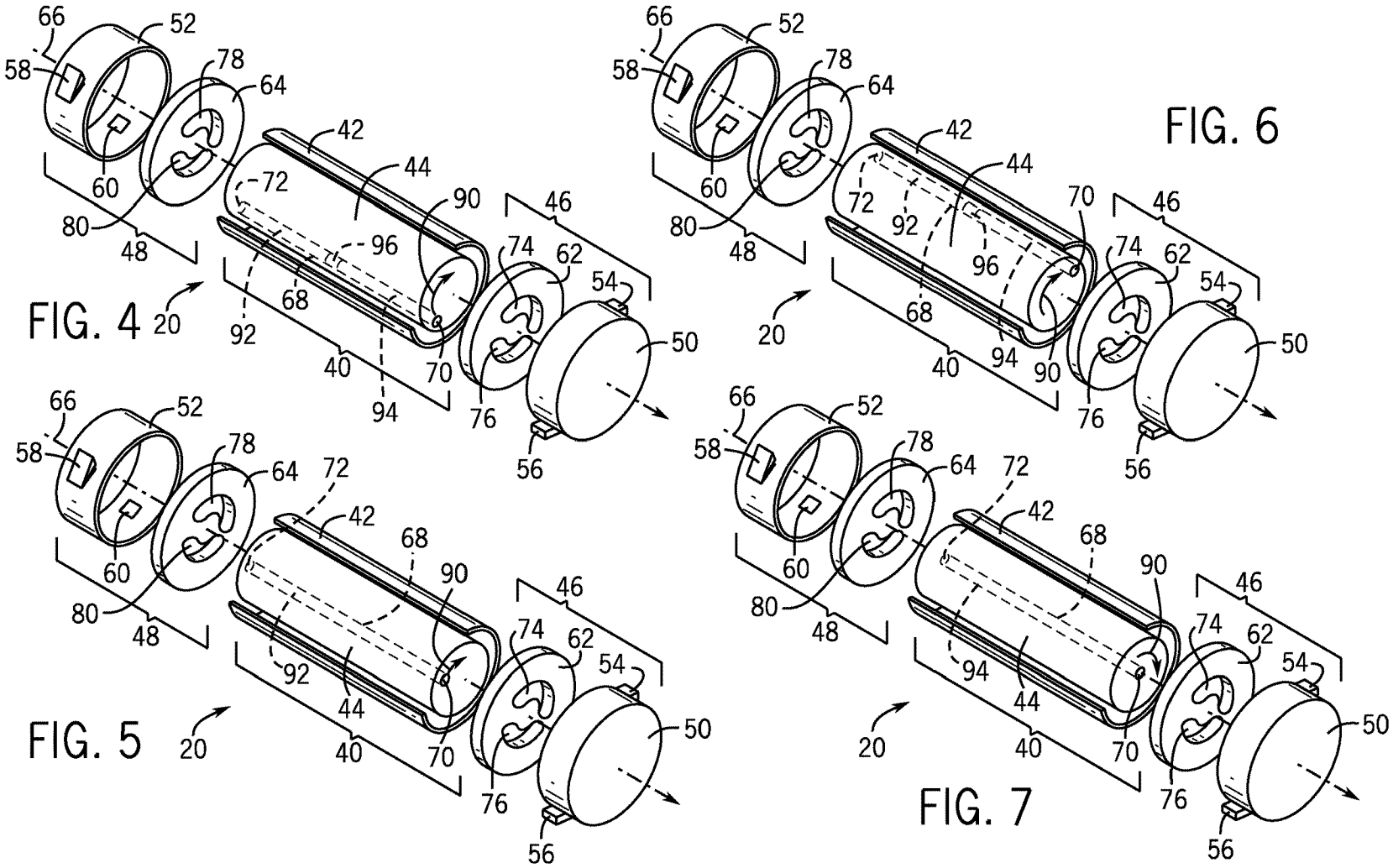
FIG. 4 is an exploded perspective view of an embodiment of a PX in a first operating position.
FIG. 5 is an exploded perspective view of an embodiment of a PX in a second operating position.
FIG. 6 is an exploded perspective view of an embodiment of a PX in a third operating position.
FIG. 7 is an exploded perspective view of an embodiment of a PX in a fourth operating position.

In FIG. 4, the channel opening 70 is in hydraulic communication with aperture 76 in endplate 62 and therefore with the manifold 50 at a first rotational position of the rotor 44. The opposite channel opening 72 is in hydraulic communication with the aperture 80 in endplate 64, and thus, in hydraulic communication with manifold 52. As discussed below, the rotor 44 rotates in the clockwise direction indicated by arrow 90. As shown in FIG. 4, low-pressure second fluid 92 passes through end plate 64 and enters the channel 68, where it pushes first fluid 94 out of the channel 68 and through end plate 62, thus exiting the rotary PX 20. The first and second fluids 92 and 94 contact one another at an interface 96 where minimal mixing of the liquids occurs because of the short duration of contact. The interface 96 is a direct contact interface because the second fluid 92 directly contacts the first fluid 94. In some embodiments, there may be a diaphragm or other barrier at the interface 96 to prevent mixing of the liquids.

In FIG. 5, the channel 68 has rotated clockwise through an arc of approximately 90 degrees, and outlet 72 is now blocked off between apertures 78 and 80 of end plate 64, and outlet 70 of the channel 68 is located between the apertures 74 and 76 of end plate 62 and, thus, blocked off from hydraulic communication with the manifold 50 of end structure 46. Thus, the low-pressure second fluid 92 is contained within the channel 68.

In FIG. 6, the channel 68 has rotated through approximately 180 degrees of arc from the position shown in FIG. 4. Opening 72 is in hydraulic communication with aperture 78 in end plate 64 and in hydraulic communication with manifold 52, and the opening 70 of the channel 68 is in hydraulic communication with aperture 74 of end plate 62 and with manifold 50 of end structure 46. The liquid in channel 68, which was at the pressure of manifold 52 of end structure 48, transfers this pressure to end structure 46 through outlet 70 and aperture 74, and comes to the pressure of manifold 50 of end structure 46. Thus, high-pressure first fluid 94 pressurizes and displaces the second fluid 92.

In FIG. 7, the channel 68 has rotated through approximately 270 degrees of arc from the position shown in FIG. 4, and the openings 70 and 72 of channel 68 are between apertures 74 and 76 of end plate 62, and between apertures 78 and 80 of end plate 64. Thus, the high-pressure first fluid 94 is contained within the channel 68. When the channel 68 rotates through approximately 360 degrees of arc from the position shown in FIG. 5, the second fluid 92 displaces the first fluid 94, restarting the cycle.

Figure 8:
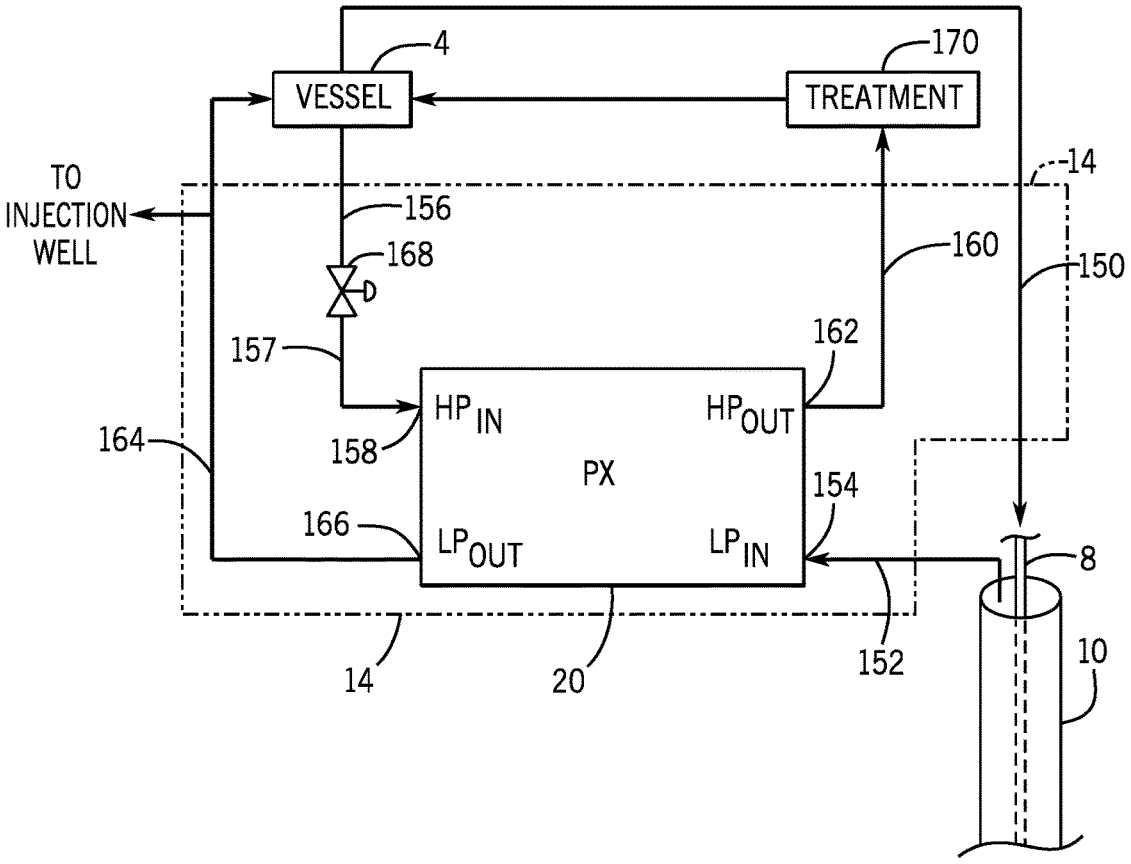
FIG. 8 is a schematic view of one embodiment of the mud return system of FIGS. 1 and 2.

FIG. 8 is a schematic view of one embodiment of the mud return system 14 of FIGS. 1 and 2. As previously described, drilling mud 150 is provided to the cutting head 12 by the vessel 4 via the drill string 8. Low pressure used drilling mud 152 is returned to the sea floor 11 via the annulus between the casing 10 and the drill string 8. The low pressure used drilling mud 152 is provided to the PX 20 via the low pressure inlet 154. High pressure energizing fluid 156 (e.g., pressurized sea water) is provided the PX 20 from the vessel 4 via a high pressure flow path or conduit 157. The high pressure energizing fluid 156 enters the PX 20 at the high pressure inlet 158. In the PX, the pressures between the low pressure used drilling mud 152 and the high pressure energizing fluid 156 are exchanged, causing the used drilling mud 152 to be pressurized and the energizing fluid 156 to become depressurized. High pressure used drilling mud 160 exits the PX 20 at the high pressure outlet 162 and is returned to the vessel 4 at the surface 6. Low pressure spent energizing fluid 164 exits the PX 20 at the low pressure outlet 166 and is either discharged into the ocean, sent to an injection well or returned to the vessel 4. Though there may be other on/off valves disposed throughout the system 14 for safety purposes, the flow rates and pressures throughout the system 14 may be controlled using a single metering valve 168 (e.g., disposed along flow path 157) adjacent the high pressure inlet 158 of the PX 20. Upon being returned to the surface 6, the used drilling mud 160 may go to a treatment station 170 before returning to the vessel 4. In some embodiments, the treatment station 170 may be on the vessel. However, embodiments in which the treatment station 170 is located below the surface 6 (e.g., at or near the sea floor 11 or some intermediate position along the casing 10) are also envisaged. The treatment performed at the treatment station 170 may include cleaning, cooling, adding chemicals, rock crushing, filtering, etc. In some embodiments, the drilling mud may be reused after treatment.

Figure 9:
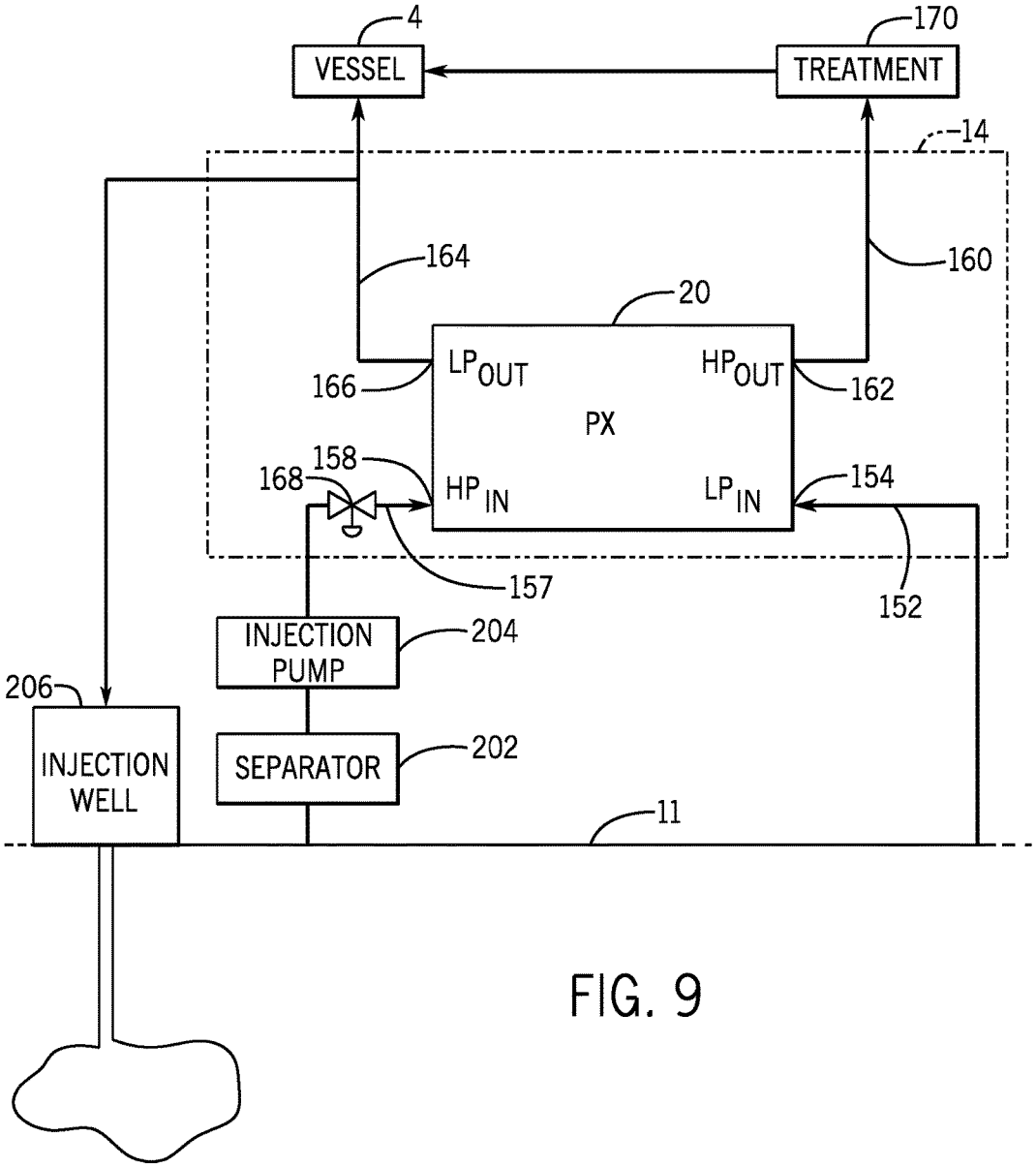
FIG. 9 is a schematic view of one embodiment of the mud return system that utilizes produced water as the high pressure energizing fluid.

FIG. 9 is a schematic view of one embodiment of the mud return system 14 that utilizes produced water as the high pressure energizing fluid. As previously described, low pressure used drilling mud 152 enters the PX 20 via the low pressure inlet 154. Produced water 200 from a separator 202 enters the PX 20 as the high pressure energizing fluid at the high pressure inlet 158 via an injection pump 204. As previously described, the flow rates and pressures throughout the system 14 may be controlled using a single metering valve 168 (e.g., disposed along flow path 157) adjacent the high pressure inlet 158 of the PX 20. In the PX, the pressures between the low pressure used drilling mud 152 and the produced water 200 are exchanged, causing the used drilling mud 152 to be pressurized and the produced water 200 to become depressurized. High pressure used drilling mud 160 exits the PX 20 at the high pressure outlet 162 and is returned to the surface 6. Low pressure spent produced water 200 exits the PX 20 at the low pressure outlet 166 and is either sent to an injection well 206 or sent to the vessel 4. Upon being returned to the surface 6, the used drilling mud 160 may go to a treatment station for cleaning, cooling, adding chemicals, rock crushing, filtering, etc. before returning to the vessel 4 and/or being reused. However, in some embodiments the low pressure spent energizing fluid 164 may be returned to the injection pump 204 to be pressurized and returned to the high pressure inlet 158 of the PX 20, rather than returned to the vessel 4.

Figure 10:
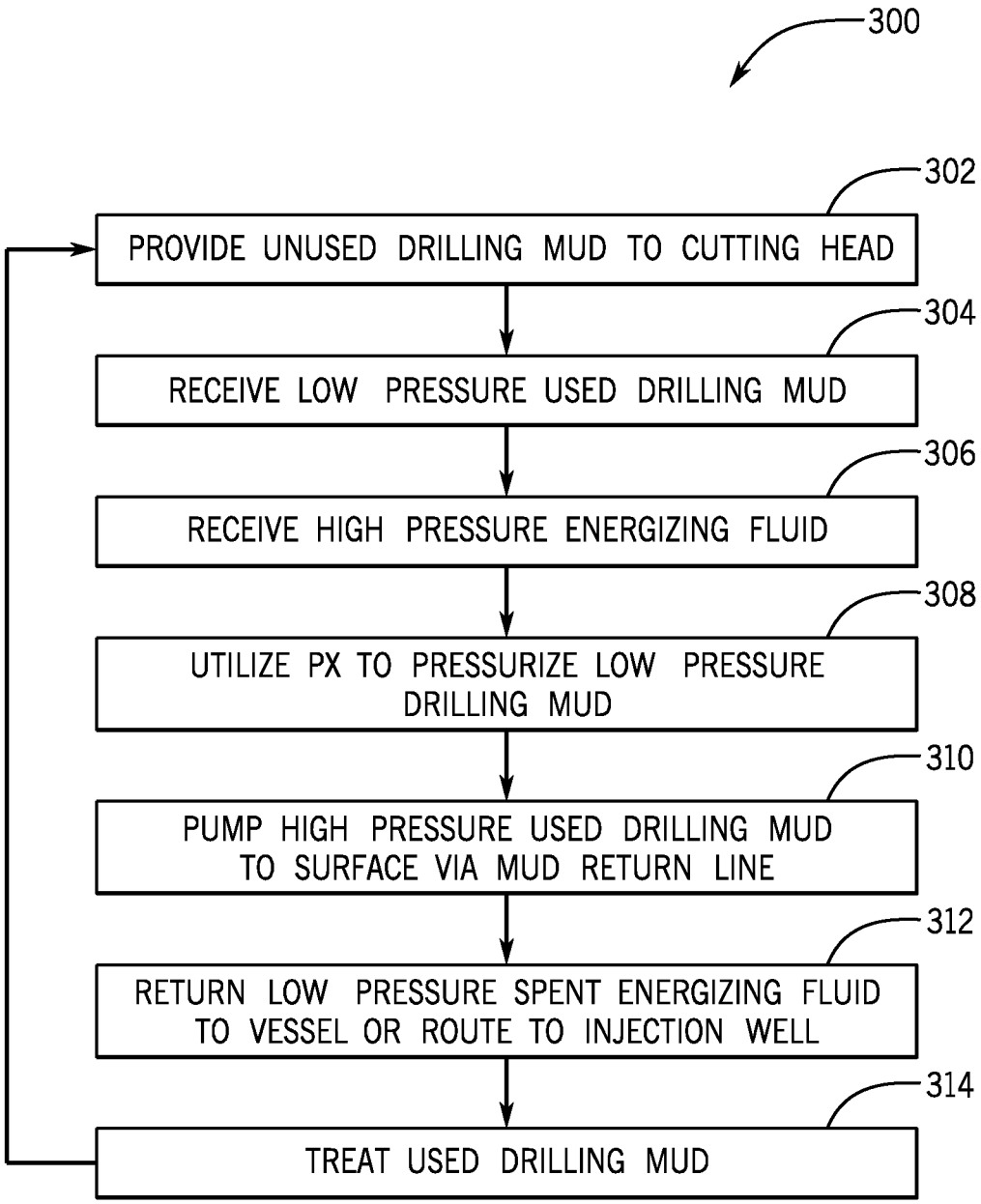
FIG. 10 is a flow chart of a process for pressurizing used drilling mud and returning it to the surface in a dual gradient drilling application.

FIG. 10 is a flow chart of a process for pressurizing used drilling mud and returning it to the surface in a dual gradient drilling application. In block 302, drilling mud is provided to the cutting head via the drill string. The drilling mud provides hydraulic power, cooling, and also carries cuttings away from the cutting head as the drilling mud is pumped back up to the sea floor in the annulus between the casing and the drill string.

In block 304 the low pressure used drilling mud is received by the PX via the low pressure inlet. At the same time, in block 306, high pressure energizing fluid is received by the PX via the high pressure inlet. The flow rates and pressures through the PX may be controlled via a metering valve disposed along the high pressure flow path adjacent the high pressure inlet of the PX.

In block 308, the pressures are exchanged between the high pressure energizing fluid and the low pressure used drilling mud. Thus, the low pressure drilling mud is pressurized and the high pressure energizing fluid if depressurized. The high pressure drilling mud exits the PX via the high pressure outlet. The low pressure spent energizing fluid exits the PX via the low pressure outlet.

In block 310 the high pressure used drilling mud is provided to the surface via the mud return line. Similarly, in block 312, the low pressure spent energizing fluids are either returned to the vessel at the surface, discharged into the ocean, or sent to an injection well.

In block 314 the used drilling mud may be treated. This may include cooling, cleaning, adding chemicals, filtering, etc. The treated mud may then be reused and provided to the cutting head via the drill string (block 302).

Using one or more PXs as the MLP in a mud return system of a dual-gradient drilling application may result in increased lifespan and increased efficiency of the MLP relative to typical systems using a diaphragm or disc pump. Additionally, flow rates and pressures of fluids flowing through the PX may be controlled via single metering valve adjacent the high pressure inlet. Furthermore, if a hydraulic PX is used, electricity need not be run to the PX at the ocean floor for operation.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system, comprising:

a mud return system, comprising:

a pressure exchanger (PX) configured to be installed in a body of water, to receive used drilling mud, to receive a second fluid, to utilize the second fluid to pressurize the drilling mud for transport, via a mud return line, from a first location at or near a floor of the body of water to a second location at or near a surface of the body of water, wherein the drilling mud and the second fluid contact one another at an interface within the PX, and wherein the second fluid is a pressurized energizing fluid received from a vessel at or near the surface of the body of water.

2. The system of claim 1, wherein the PX comprises a high pressure inlet configured to receive the second fluid, and the system comprises a metering valve disposed along a flow path coupled to the high pressure inlet, wherein the metering valve is configured to control a flow rate of the second fluid into the high pressure inlet.

3. The system of claim 1, wherein the pressurized energizing fluid comprises pressurized water from the body of water, drilling mud, a subset of the ingredients in drilling mud, or some combination thereof.

4. The system of claim 1, comprising an injection pump disposed at or near the floor of the body of water, wherein the injection pump is configured to pressurize the second fluid and provide the second fluid to the PX.

5. The system of claim 4, wherein the second fluid comprises produced water from a nearby well.

6. The system of claim 5, comprising a separator configured to separate produced water from the output of a production well and to provide produced water to the injection pump.

7. The system of claim 1, comprising a treatment station at or near the surface of the body of water, wherein the treatment station is configured to receive the drilling mud from the mud return line and to treat the drilling mud.

8. The system of claim 7, wherein treatment of the drilling mud comprises cleaning, cooling, adding chemicals, rock crushing, filtering, or a combination thereof.

9. The system of claim 7, wherein the treated drilling mud is pumped down a drill string toward a cutting head of a drilling application.

10. The system of claim 1, wherein the second fluid exits the PX via a low pressure outlet and is discharged into the body of water or routed to an injection well.

11. The system of claim 1, wherein the PX comprises:

first and second end structures at respective first and second ends of the PX;

a rotor disposed between the first and second end structures; and a housing disposed about the rotor.

12. The system of claim 11, wherein the rotor comprises a plurality of channels extending longitudinally through the rotor.

13. The system of claim 12, wherein the first and second end structures each comprise a manifold and an end plate disposed within the manifold, wherein the end plate is in fluid communication with the plurality of channels.

14. A pressure exchanger (PX), comprising:

a low pressure inlet fluidly coupled to a source of used drilling mud and configured to receive the used drilling mud from the source of the used drilling mud, wherein the source of the used drilling mud comprises a drilling application;

a high pressure inlet configured to receive a second fluid;

a low pressure outlet configured to output the second fluid; and a high pressure outlet fluidly coupled to a mud return line and configured to output the drilling mud to the mud return line, wherein the mud return line is configured to transport the drilling mud from a first location at or near a floor of a body of water to a second location at or near a surface of the body of water;

wherein the PX is configured to utilize the second fluid to pressurize the drilling mud, and wherein the drilling mud and the second fluid contact one another at an interface within the PX.

15. A method, comprising:

receiving used drilling mud from a drilling application via a low pressure inlet of a pressure exchanger (PX) configured to be installed in a body of water;

receiving a second fluid via a high pressure inlet of the PX;

utilizing the second fluid to pressurize the drilling mud within the PX, wherein the drilling mud and the second fluid contact one another at an interface within the PX;

outputting the drilling mud to a mud return line via a high pressure outlet of the PX, wherein the mud return line is configured to transport the drilling mud from a first location at or near a floor of the body of water to a second location at or near a surface of the body of water; and outputting the second fluid via a low pressure outlet of the PX.

16. The method of claim 15, comprising discharging the second fluid into the body of water surrounding the PX.

17. The method of claim 15, comprising controlling, via a metering valve, a flow rate of the second fluid into the high pressure inlet of the PX.

18. The method of claim 15, comprising pressurizing water produced by the drilling application and providing the pressurized produced water to the high pressure inlet of the PX, wherein the second fluid comprises the produced water.

19. A system, comprising:

a mud return system, comprising:

a pressure exchanger (PX) configured to be installed in a body of water, to receive used drilling mud, to receive a second fluid, to utilize the second fluid to pressurize the drilling mud for transport, via a mud return line, from a first location at or near a floor of the body of water to a second location at or near a surface of the body of water, wherein the drilling mud and the second fluid contact one another at an interface within the PX, wherein the used drilling mud is pumped through an annulus defined by a casing and a drill string of a drilling application and provided to a low pressure inlet of the PX.

* * * * *